US010746484B2

(12) United States Patent
Zhang

(10) Patent No.: US 10,746,484 B2
(45) Date of Patent: Aug. 18, 2020

(54) METHODS AND SYSTEMS FOR A HEAT EXCHANGER

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 86 days.

(21) Appl. No.: 15/710,651

(22) Filed: Sep. 20, 2017

(65) Prior Publication Data

US 2019/0086166 A1 Mar. 21, 2019

(51) Int. Cl.

| | |
|---|---|
| ***F28F 27/02*** | (2006.01) |
| ***F28D 21/00*** | (2006.01) |
| ***F28D 7/00*** | (2006.01) |
| ***F28D 9/00*** | (2006.01) |
| ***F28D 7/08*** | (2006.01) |
| *F02M 26/00* | (2016.01) |
| *F02M 26/70* | (2016.01) |
| *F28D 9/02* | (2006.01) |

(52) U.S. Cl.

CPC ..... *F28F 27/02* (2013.01); *F28D 7/0066* (2013.01); *F28D 7/082* (2013.01); *F28D 9/0093* (2013.01); *F28D 21/0003* (2013.01); *F02M 26/70* (2016.02); *F02M 2026/004* (2016.02); *F28D 7/0058* (2013.01); *F28D 9/0062* (2013.01); *F28D 9/02* (2013.01); *F28D 2021/0082* (2013.01)

(58) Field of Classification Search

CPC .. F02M 26/05–07; F02M 26/24; F02M 26/28; F02M 26/32; F28F 27/02; F28F 2250/06

See application file for complete search history.

(56) References Cited

U.S. PATENT DOCUMENTS

| | | | | |
|---|---|---|---|---|
| 5,353,757 | A * | 10/1994 | Susa | F01P 3/20 123/41.29 |
| 5,732,688 | A * | 3/1998 | Charlton | F02D 21/08 123/568.12 |
| 6,293,337 | B1 | 9/2001 | Strahle et al. | |
| 8,955,473 | B2 | 2/2015 | Zhang | |
| 9,494,112 | B2 | 11/2016 | Janke et al. | |
| 2009/0084364 | A1* | 4/2009 | Martins | F01P 1/06 123/563 |
| 2012/0023937 | A1* | 2/2012 | Styles | F02D 9/02 60/605.2 |
| 2014/0075974 | A1* | 3/2014 | Klein | B60H 1/3202 62/119 |

FOREIGN PATENT DOCUMENTS

| | | | | |
|---|---|---|---|---|
| FR | 2913491 | A1 * | 9/2008 | F02B 29/0412 |
| JP | 2007315231 | A * | 12/2007 | |

* cited by examiner

*Primary Examiner* — Eric S Ruppert

(74) *Attorney, Agent, or Firm* — Geoffrey Brumbaugh; McCoy Russell LLP

(57) ABSTRACT

Methods and systems are provided for a heat exchanger. In one example, a method may include adjusting a flap to adjust a number of conduits configured to receive exhaust gas recirculate and exhaust gas within the heat exchanger.

14 Claims, 6 Drawing Sheets

METHODS AND SYSTEMS FOR A HEAT EXCHANGER

FIELD

The present description relates generally to a heat exchanger.

BACKGROUND/SUMMARY

Various devices are utilized in vehicles to increase efficiency and decrease thermal degradation of components. These devices may include various types of coolers configured to flow two or more fluids therethrough. A first fluid may comprise coolant and a second fluid may comprise a gas. The first and second fluids are prevented from mixing with one another while being permitted to thermally communicate. Based on the application, the cooler may be used to increase power output, decrease surface temperature, decrease emissions, and/or recover thermal energy. However, these coolers are separated from one another, each performing a specific task, which may lead to high manufacturing costs and packaging constraints.

Modern heat exchangers include two or more inlets and corresponding outlets to enable the heat exchangers to receive various intake and exhaust gas flows. As such, a single heat exchanger may function as a charge air cooler (CAC), exhaust gas recirculation (EGR) cooler, and heat recovery device. While these designs may reduce costs and packaging constraints presented by previous models, they do have some drawbacks. For example, the heat exchanger is partitioned for each function it may perform (e.g., CAC, EGR cooler, heat recovery, etc.). However, a volume of each partition is fixed. This prevents the heat exchanger from increasing exposure of intake or exhaust gases to coolant flowing therethrough.

The inventors have identified the above problems and have come up with a solution to solve them. In one example, the issues described above may be addressed by a method comprising adjusting a number of heat exchanger conduits allocated to receive exhaust gas recirculate and correspondingly adjusting a number of heat exchanger conduits allocated to receive exhaust gas by pivoting a flap, and where the heat exchanger conduits are fluidly sealed from one another. In this way, a single heat exchanger may comprise a variable volume to receive different gases.

As one example, the volume of the heat exchanger configured to receive EGR may increase in response to an increased EGR demand. As another example, the volume of heat exchanger configured to receive exhaust gas may increase in response to an increased heat recovery demand. This may be accomplished by actuated the flap of the heat exchanger to direct a gas to a desired number of conduits, where the position of the flap corresponds to a number of conduits configured to receive EGR and exhaust gas. By doing this, a packaging constraint of the heat exchanger is reduced compared to previous attempts. Additionally, a manufacturing cost of the heat exchanger is reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
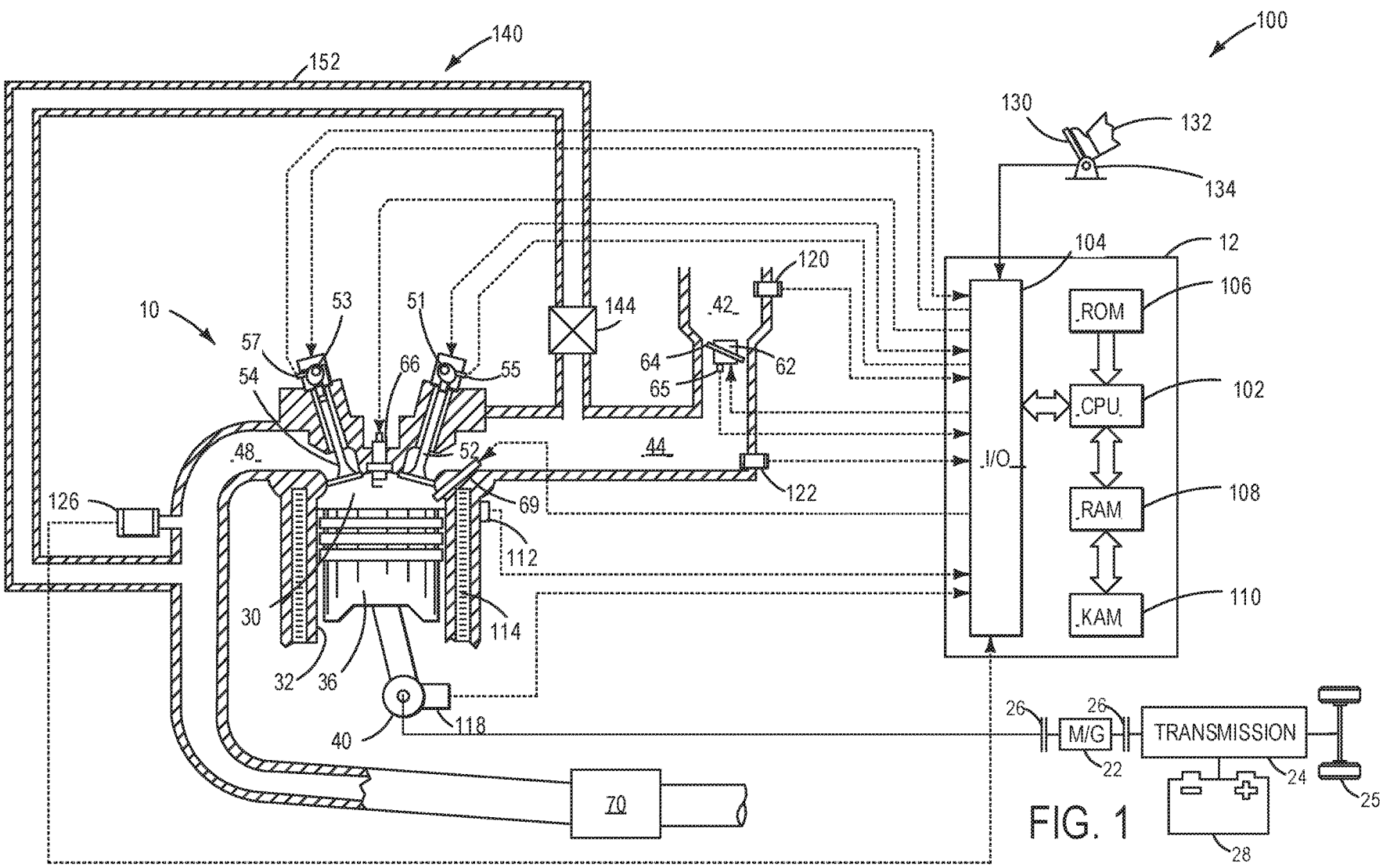
FIG. 1 shows an engine comprising a single cylinder.
Figure 2:
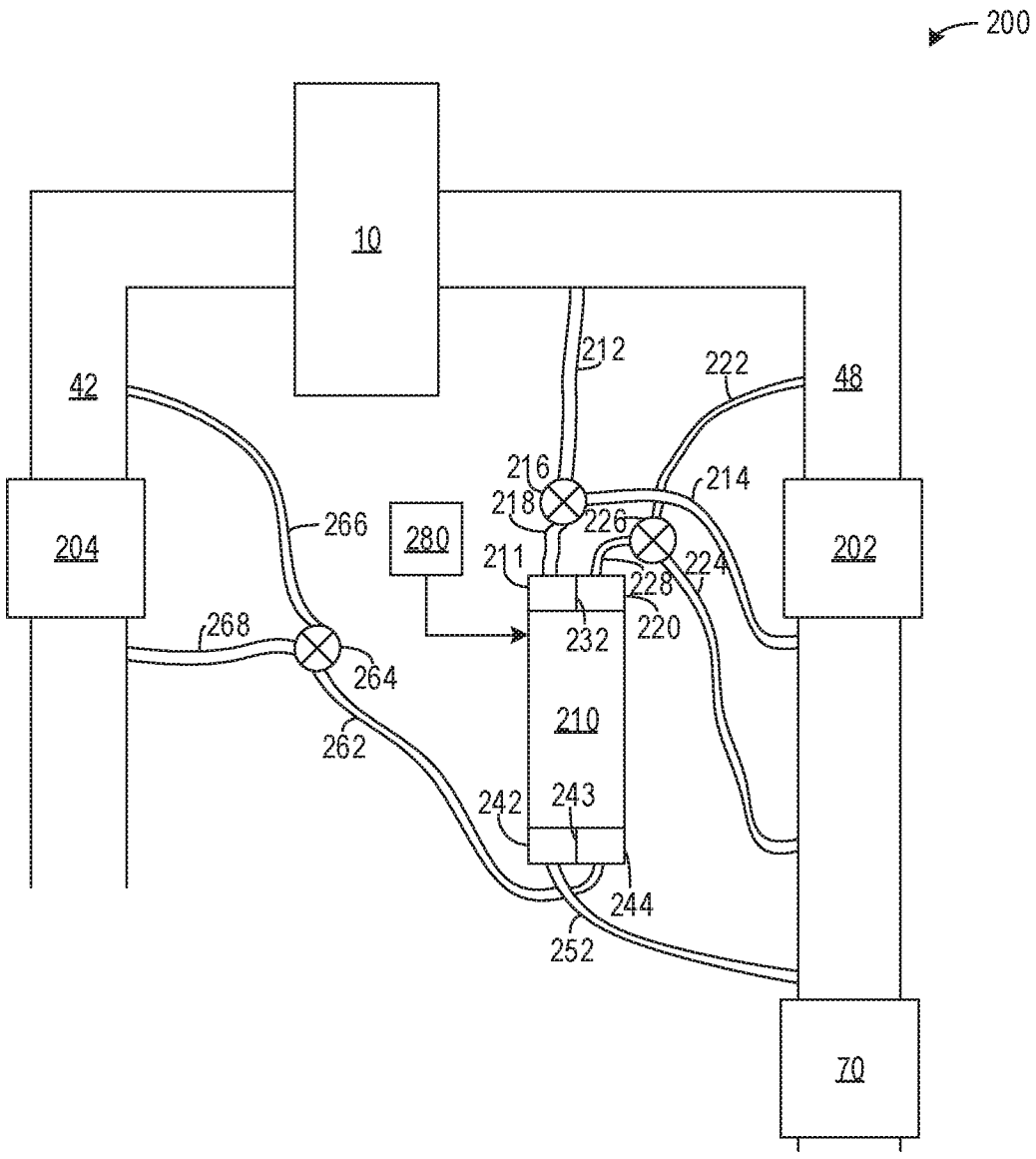
FIG. 2 shows a heat exchanger being fluidly coupled to passages of the engine.
Figure 3:
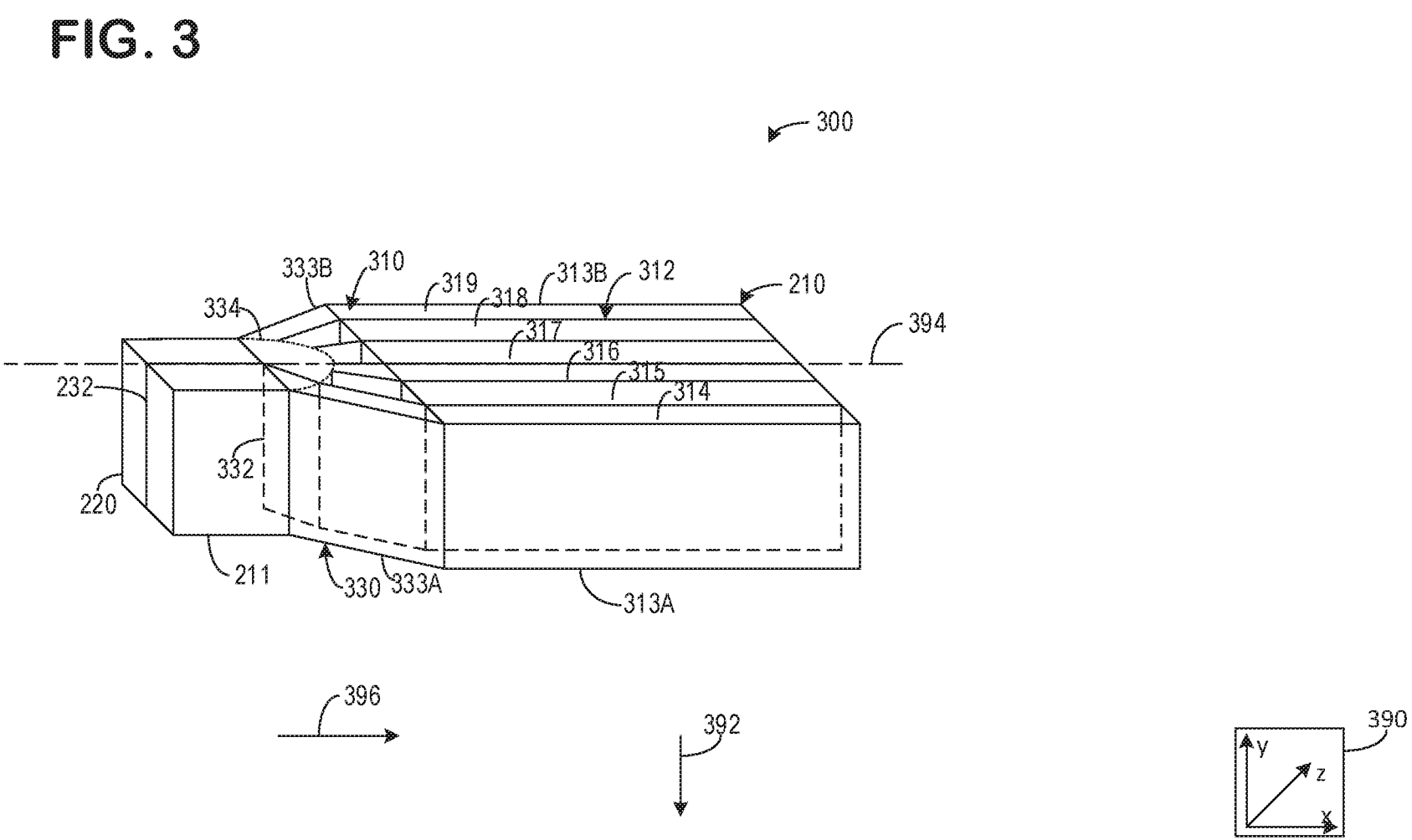
FIG. 3 shows a perspective view of the heat exchanger and its conduits.
Figure 4:
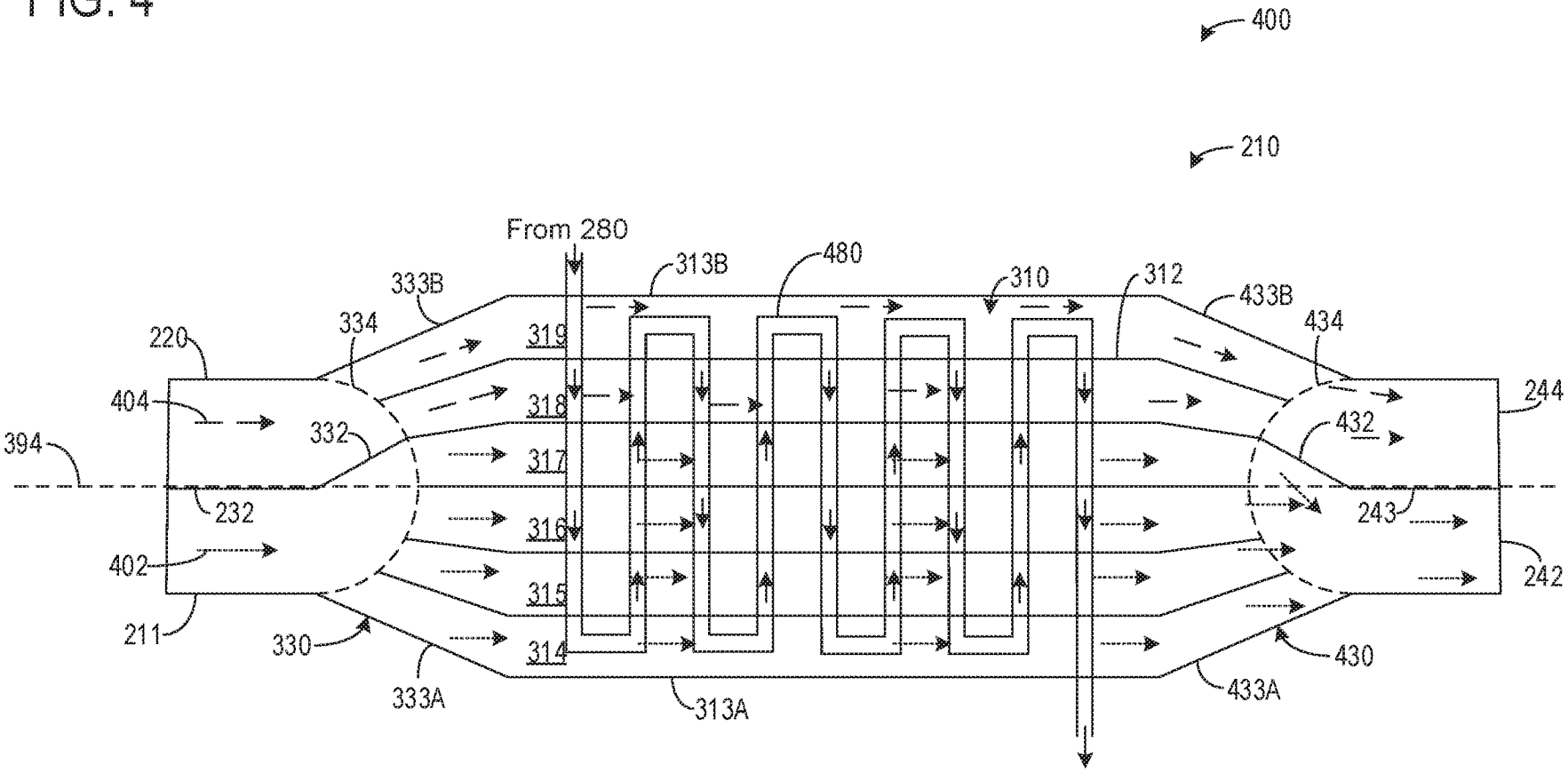
FIG. 4 shows a cross-sectional view of the heat exchanger and example gas flows therethrough.
Figure 5:
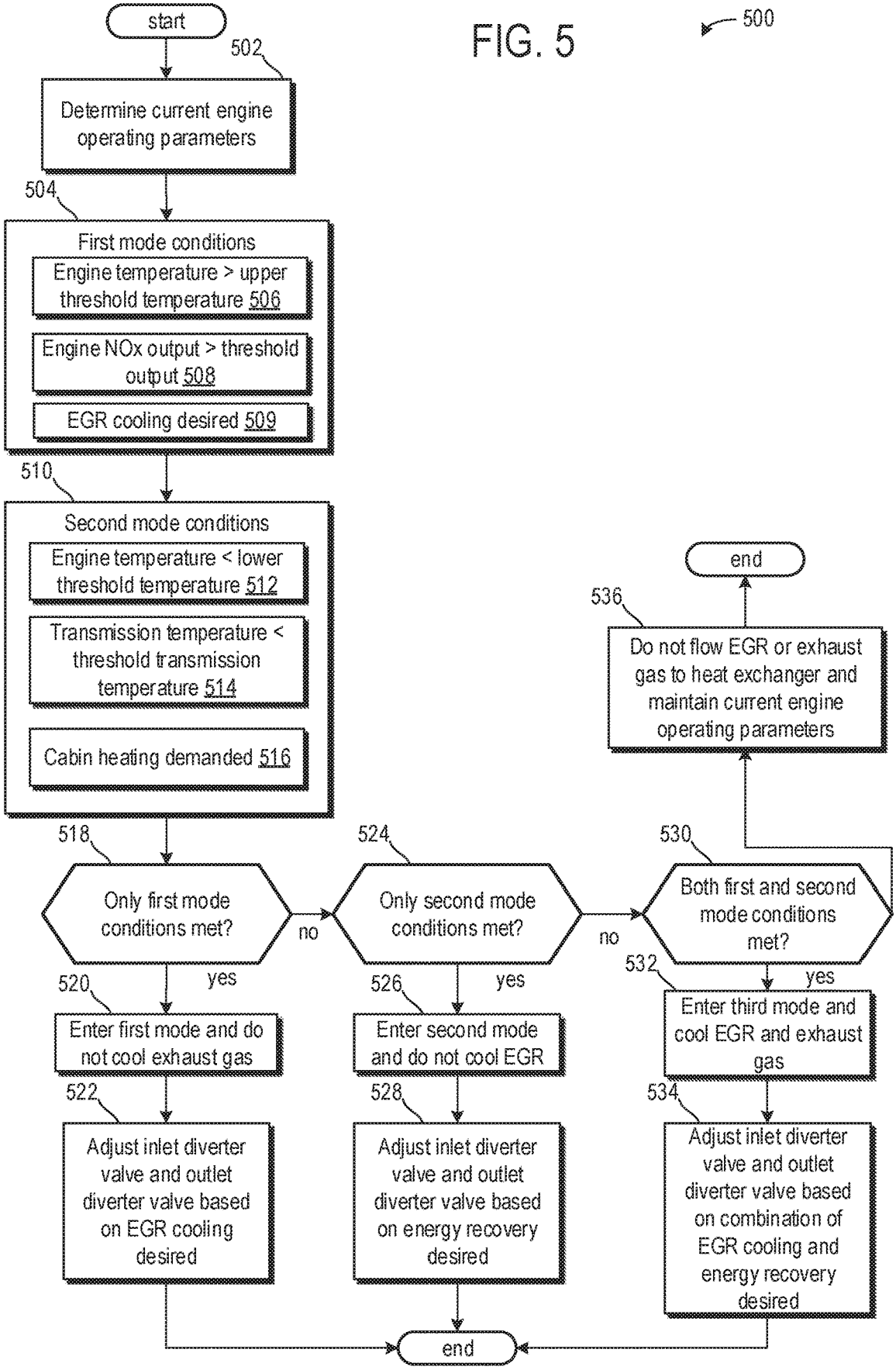
FIG. 5 shows a method for adjusting one or more valves of the heat exchanger.
Figure 6:
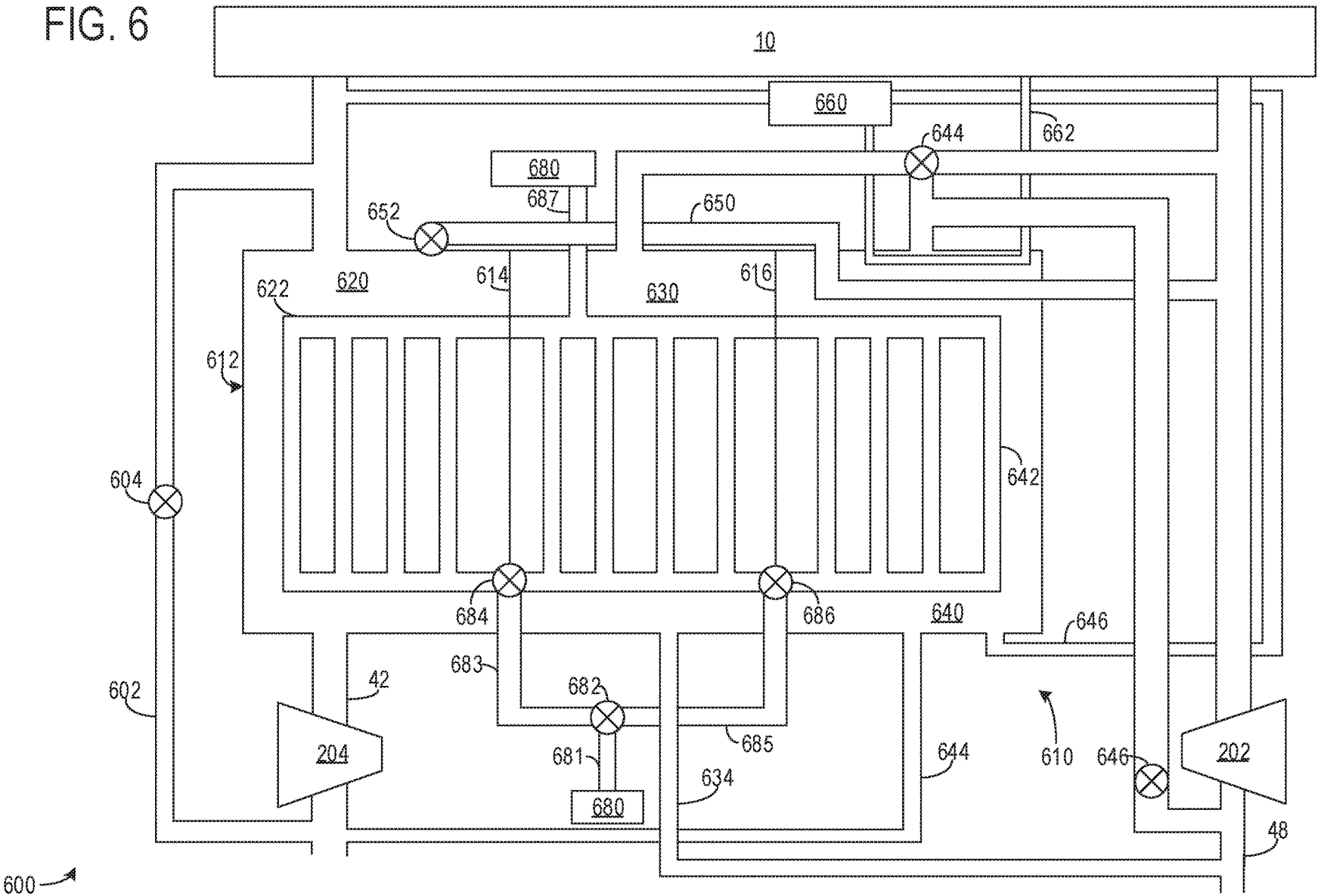
FIG. 6 shows an alternate embodiment of the heat exchanger.

The following description relates to systems and methods for a heat exchanger having a valve element configured to adjust a number of conduits configured to receive EGR or exhaust gas. An engine having a single cylinder of a plurality of cylinders is shown in FIG. 1. The heat exchanger may be fluidly coupled to intake and exhaust passages of the engine. As such, the heat exchanger may thermally communicate with exhaust gas and EGR based on a position of one or more valves as shown in FIG. 2. The heat exchanger comprises a plurality of conduits, each conduits being hermetically sealed. Thus, gases in adjacent conduits do not mix. The heat exchanger, along with an inlet diverter valve and/or flap, is shown in FIG. 3. A cross-section of the heat exchanger is shown in FIG. 4. The cross-section further depicts an example gas flow through the heat exchanger. The example flow illustrating a first number of conduits being configured to receive EGR and a second, different number of conduits being configured to receive exhaust gas. A method for adjusting a volume and/or number of conduits configured to receive EGR and exhaust gas is shown in FIG. 5. An alternate embodiment of the heat exchanger is shown in FIG. 6, where the heat exchanger further comprises a chamber configured to cool charge air.

FIGS. 1-4 and 6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Note that FIG. 4 shows arrows indicating where there is space for fluid to flow, and the solid lines of the device walls show where flow is blocked and communication is not possible due to the lack of fluidic communication created by the device walls spanning from one point to another. The walls create separation between regions, except for openings in the wall which allow for the described fluid communication.

Continuing to FIG. 1, a schematic diagram showing one cylinder of a multi-cylinder engine 10 in an engine system 100, which may be included in a propulsion system of an automobile, is shown. The engine 10 may be controlled at least partially by a control system including a controller 12 and by input from a vehicle operator 132 via an input device 130. In this example, the input device 130 includes an accelerator pedal and a pedal position sensor 134 for generating a proportional pedal position signal. A combustion chamber 30 of the engine 10 may include a cylinder formed by cylinder walls 32 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle 5 via an intermediate transmission system. Further, a starter motor may be coupled to the crankshaft 40 via a flywheel to enable a starting operation of the engine 10.

The combustion chamber 30 may receive intake air from an intake manifold 44 via an intake passage 42 and may exhaust combustion gases via an exhaust passage 48. The intake manifold 44 and the exhaust passage 48 can selectively communicate with the combustion chamber 30 via respective intake valve 52 and exhaust valve 54. In some examples, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative examples, the intake valve 52 and/or exhaust valve 54 may be controlled by electric valve actuation. For example, the cylinder 30 may alternatively include an intake valve controlled via electric valve actuation and an exhaust valve controlled via cam actuation including CPS and/or VCT systems.

A fuel injector 69 is shown coupled directly to combustion chamber 30 for injecting fuel directly therein in proportion to the pulse width of a signal received from the controller 12. In this manner, the fuel injector 69 provides what is known as direct injection of fuel into the combustion chamber 30. The fuel injector 69 may be mounted in the side of the combustion chamber or in the top of the combustion chamber, for example. Fuel may be delivered to the fuel injector 69 by a fuel system (not shown) including a fuel tank, a fuel pump, and a fuel rail. In some examples, the combustion chamber 30 may alternatively or additionally include a fuel injector arranged in the intake manifold 44 in a configuration that provides what is known as port injection of fuel into the intake port upstream of the combustion chamber 30.

Spark is provided to combustion chamber 30 via spark plug 66. The ignition system may further comprise an ignition coil (not shown) for increasing voltage supplied to spark plug 66. In other examples, such as a diesel, spark plug 66 may be omitted.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal. The intake passage 42 may include a mass air flow sensor 120 and a manifold air pressure sensor 122 for sensing an amount of air entering engine 10.

An exhaust gas sensor 126 is shown coupled to the exhaust passage 48 upstream of an emission control device 70 according to a direction of exhaust flow. The sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), $NO_x$, HC, or CO sensor. In one example, upstream exhaust gas sensor 126 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 70 is shown arranged along the exhaust passage 48 downstream of the exhaust gas sensor 126. The device 70 may be a three-way catalyst (TWC), particulate filter, diesel oxidation catalyst, $NO_x$ trap, various other emission control devices, or combinations thereof. In some examples, during operation of the engine 10, the emission control device 70 may be periodically reset by operating at least one cylinder of the engine within a particular air-fuel ratio.

An exhaust gas recirculation (EGR) system 140 may route a desired portion of exhaust gas from a portion of the exhaust passage 48 upstream of the emission control device 70 to the intake manifold 44 via an EGR passage 152. The amount of EGR provided to the intake manifold 44 may be varied by the controller 12 via an EGR valve 144. Under some conditions, the EGR system 140 may be used to regulate the temperature of the air-fuel mixture within the combustion chamber, thus providing a method of controlling the timing of ignition during some combustion modes.

The controller 12 is shown in FIG. 1 as a microcomputer, including a microprocessor unit 102, input/output ports 104, an electronic storage medium for executable programs and calibration values shown as read only memory chip 106 (e.g., non-transitory memory) in this particular example, random access memory 108, keep alive memory 110, and a data bus. The controller 12 may receive various signals from sensors coupled to the engine 10, in addition to those signals previously discussed, including measurement of inducted mass air flow (MAF) from the mass air flow sensor 120; engine coolant temperature (ECT) from a temperature sensor 112 coupled to a cooling sleeve 114; an engine position signal from a Hall effect sensor 118 (or other type) sensing a position of crankshaft 40; throttle position from a throttle position sensor 65; and manifold absolute pressure (MAP) signal from the sensor 122. An engine speed signal may be generated by the controller 12 from crankshaft position sensor 118. Manifold pressure signal also provides an indication of vacuum, or pressure, in the intake manifold 44. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing the methods described below as well as other variants that are anticipated but not specifically listed. The controller 12 receives signals from the various sensors of FIG. 1 and employs the various actuators of FIG. 1 to adjust engine operation based on the received signals and instructions stored on a memory of the controller.

In some examples, vehicle 5 may be a hybrid vehicle with multiple sources of torque available to one or more vehicle wheels 25. In other examples, vehicle 5 is a conventional vehicle with only an engine, or an electric vehicle with only electric machine(s). In the example shown, vehicle 5 includes engine 10 and an electric machine 22. Electric machine 22 may be a motor or a motor/generator. Crankshaft 40 of engine 10 and electric machine 22 are connected via a transmission 24 to vehicle wheels 25 when one or more clutches 26 are engaged. In the depicted example, a first clutch 26 is provided between crankshaft 40 and electric machine 22, and a second clutch 26 is provided between electric machine 22 and transmission 24. Controller 12 may send a signal to an actuator of each clutch 26 to engage or disengage the clutch, so as to connect or disconnect crankshaft 40 from electric machine 22 and the components connected thereto, and/or connect or disconnect electric machine 22 from transmission 24 and the components connected thereto. Transmission 24 may be a gearbox, a planetary gear system, or another type of transmission. The powertrain may be configured in various manners including as a parallel, a series, or a series-parallel hybrid vehicle.

Electric machine 22 receives electrical power from a traction battery 28 to provide torque to vehicle wheels 25. Electric machine 22 may also be operated as a generator to provide electrical power to charge battery 28, for example during a braking operation. In some examples, the electric machine 22 may be used to remove EGR to boost torque during transient conditions. For example, EGR may occupy passages of a heat exchanger (e.g., the heat exchangers of FIGS. 2-4 or FIG. 6), which may decrease combustion stability during conditions where EGR is not desired. This may be prevented by removing the EGR during transient conditions (e.g., tip-in).

Turning now to FIG. 2, it shows an embodiment 200 of the engine 10 depicted in FIG. 1. As such, components previously presented may be similarly numbered in subsequent figures. In the embodiment 200, the engine 10 is turbocharged via a turbine 202 and a compressor 204, where the compressor 204 may be driven via exhaust gas driving the turbine 202 due to rotational motion of a shaft (not shown) coupled therebetween.

A heat transfer device 210 is shown comprising a plurality of inlet and outlet passages fluidly coupling the heat transfer device 210 to the intake 42 and exhaust 48 passages. Herein, the heat transfer device 210 may also be interchangeably referred to as the heat exchanger 210. A coolant system 280 may be fluidly coupled to passages traversing conduits of the heat exchanger 210. Coolant passages arranged in the heat exchanger 210 along with the conduits are shown in greater detail with respect to FIG. 3. In one example, the coolant system 280 is the same coolant system used to flow coolant to a cooling sleeve (e.g., cooling sleeve 114 of FIG. 1) of engine 10. Thus, the coolant used to thermally communicate with components of the engine 10 may be the same coolant used to thermally communicate with liquids and/or gases flowing through the heat exchanger 210.

Additionally or alternatively, the coolant system 280 may be different coolant system than the coolant system used to flow to cavities of the engine 10. In one example, the coolant system 280 and the engine coolant system may be completely fluidly separated from one another except for shared use of one or more degas bottles. Additionally or alternatively, one or both of the coolant system 280 and the engine coolant system may both be simultaneously used to thermally communicate with cavities of a transmission, a brake system, a heater core, a battery, and the like.

In additional examples, the coolant system 280 may be fluidly coupled to the engine 10, the heat exchanger 210, and other vehicle devices suitable for receiving coolant, while the engine 10 further comprises an engine cooling system dedicated to flowing coolant to only the engine.

The heat exchanger 210 may comprise a plastic, ceramic, iron, or other suitable material configured to thermally isolate interior contents of the heat exchanger 210 from an ambient atmosphere. In some examples, additionally or alternatively, one or more external and/or internal surfaces of the heat exchanger 210 may be double-walled, wherein a gas and/or liquid is arranged between a first wall and a second wall of the double-walled construction. The gas and/or liquid may further thermally insulate the heat exchanger 210 and one or more passages arranged therein.

The heat exchanger 210 may comprise a first inlet 211 fluidly coupled to a high-pressure exhaust inlet line 212 and a low-pressure exhaust inlet line 214. The high-pressure exhaust inlet line 212 may be fluidly coupled to a portion of the exhaust passage 48 between the engine 10 and the turbine 202. Thus, the high-pressure exhaust inlet line 212 may draw exhaust gas from upstream of the turbine 202 and direct the high-pressure exhaust gas to the first inlet 211. The low-pressure exhaust inlet line 214 may be fluidly coupled to a portion of the exhaust passage 48 downstream of the turbine 202. The low-pressure exhaust inlet line 214 may direct low-pressure exhaust gas to the first inlet 211.

A first inlet valve 216 may be arranged at an intersection between each of the high-pressure exhaust inlet line 212, low-pressure exhaust inlet line 214, and a first inlet line 218, the first inlet line 218 fluidly coupling one of the high-pressure 212 and the low-pressure 214 exhaust inlet lines based on a position of the first inlet valve 216. The valve 216 may be configured to adjust an amount of exhaust gas flowing from the high-pressure 212 and low-pressure 214 exhaust inlet lines to the first inlet line 218. In one example, the valve 216 is a three-way valve. The valve 216 may be operated hydraulically, pneumatically, electrically, mechanically, or the like without departing from the scope of the present disclosure. The valve 216 may be configured to prevent exhaust gas flow from the high-pressure exhaust inlet line 212 to the first inlet line 218 while allowing exhaust gas flow from the low-pressure exhaust inlet line 214 to the first inlet line 218. Alternatively, the valve 216 may be configured to prevent exhaust gas flow from the low-pressure exhaust inlet line 214 to the first inlet line 218 while allowing exhaust gas flow from the high-pressure exhaust inlet line 212 to the first inlet line 218. In some examples, exhaust gas from only one of the high- or low-pressure exhaust lines may flow into the first inlet line 218 due to the pressure difference between the exhaust gas flows. Flowing high- or low-pressure exhaust gas into the first inlet line 218 may be based on one or more conditions, including but not limited to engine load, compressor surge limit, exhaust gas temperature, EGR flow rate, engine temperature, and the like. For example, high-pressure exhaust gas may flow into the first inlet line 218 when an engine load is low and driver demand is sufficiently met. However, if the engine load is high and a high amount of boost is desired, then low-pressure exhaust gas, from downstream of the turbine 202, may be directed to the first inlet line 218.

The heat exchanger 210 may further comprise a second inlet 220 fluidly coupled selectively to both a high-pressure EGR inlet line 222 and a low-pressure EGR inlet line 224. The high-pressure EGR inlet line 222 may be fluidly coupled to a portion of the exhaust passage 48 between the engine 10 and the turbine 202. In one example, the high-pressure EGR inlet line 222 draws exhaust gas from exactly the same location as the high-pressure exhaust gas inlet line 212. In some examples, additionally or alternatively, the high-pressure EGR inlet line 222 may branch from the high-pressure exhaust gas inlet line 212. The low-pressure EGR inlet line 224 is fluidly coupled to a portion of the exhaust passage 48 downstream of the turbine 202. In one example, the low-pressure EGR inlet line 224 is fluidly coupled to a portion of the exhaust passage 48 downstream of the turbine 202 and upstream of any aftertreatment devices arranged downstream of the turbine 202 (e.g., emission control device 70).

It will be appreciated that the terms upstream and downstream refer to a position of components relative to a direction of gas flow. As such, for components arranged in the exhaust passage 48, a first component being arranged upstream of a second component also includes the first component being closer to the engine 10 than the second component.

A second inlet valve 226 may be arranged at an intersection between each of the high-pressure EGR inlet line 222, low-pressure EGR inlet line 224, and a second inlet line 228, the second inlet line 228 fluidly coupling one of the high 222 or low-pressure 224 EGR inlet lines based on a position of the second inlet valve 226. The valve 226 may be configured to adjust an amount of exhaust gas flowing from the high-pressure 222 or low-pressure 224 EGR inlet lines to the second inlet line 228. In one example, the second inlet valve 226 is substantially identical to the first valve 216. However, operation of the second valve 226 may be based on different or similar engine operating parameters as the first valve 216. The second valve 226 may be configured to allow only one of the high-pressure EGR inlet line 222 or the low-pressure EGR inlet line 224 to flow exhaust gas into the second inlet line 228 at a time. The second inlet line 228 may fluidly couple the high-pressure 222 and low-pressure 224 EGR inlet lines to the second inlet 220 of the heat exchanger 210.

The first inlet 211 and the second inlet 220 may be fluidly separated in the heat exchanger 210 via a barrier 232. The barrier 232 may hermetically seal the first inlet 211 from the second inlet 220. The heat exchanger 210 may comprise a plurality of conduits longitudinally extending from the first inlet 211 and the second inlet 220 toward a first outlet 242 and a second outlet 244. A flow diverter valve may be arranged between the barrier 232 and openings of the conduits, as will be described below. The barrier 232 may comprise of a thermally insulating material (such as the materials described above) and/or a double-walled construction. In one example, the barrier 232 is comprised of a material similar to the heat exchanger 210.

The heat exchanger 210 may be configured such that gases entering the first inlet 211 flow through conduits of the heat exchanger 210 and flow into the first outlet 242 without mixing with gases entering the second inlet 220. Similarly, gases entering the second inlet 220 flow through conduits of the heat exchanger 210 and flow into the second outlet 244 without mixing with gases from the first inlet 211. In this way, two distinct gases may flow through the heat exchanger 210 without mixing and/or merging and/or combining. In one example, a portion of the heat exchanger 210 may be configured to perform exhaust gas heat recovery and a remaining portion of the heat exchanger 210 may be configured to cool EGR.

The first outlet 242 may be fluidly coupled to a first outlet line 252 which leads to a portion of the exhaust passage 48 between the turbine 202 and the emission control device 70. In one example, the exhaust gas in the first outlet line 252 is not led to upstream of the turbine 202 due to a pressure difference between exhaust gas upstream of the turbine 202 and exhaust gas in the first outlet line 252.

The second outlet 244 may be fluidly coupled to a second outlet line 262, which leads to a second outlet valve 264. In one example, the second outlet valve 264 is a three-way valve and is substantially similar to the second inlet valve 226 or the first inlet valve 216. The second outlet valve 264 may direct gases from the second outlet line 262 to one or more of a high-pressure EGR outlet line 266 and a low-pressure EGR outlet line 268. The high-pressure EGR outlet line 266 may direct EGR from the heat exchanger 210 to a portion of the intake passage 42 downstream of the compressor 204. Thus, the low-pressure EGR outlet line 268 may direct EGR from the heat exchanger 210 to a portion of the inlet passage 42 upstream of the engine 10 and downstream of the compressor 204.

In one example, operation of the second outlet valve 264 mimics operation of the second inlet valve 226. For example, if the second inlet valve 226 is moved to a position where high-pressure EGR flows through the high-pressure EGR inlet line 222 to the second inlet 220 and low-pressure exhaust gas does not flow to the second inlet 220, then the second outlet valve 264 is moved to a similar position where exhaust gas from the second outlet 244 is directed through the high-pressure EGR outlet line 266 to a portion of the intake passage 42 downstream of the compressor 204. Thus, if the second inlet valve 226 is moved to a position where low-pressure exhaust gas flows through the low-pressure EGR inlet line 224 to the second inlet and high-pressure exhaust gas does not flow to the second inlet 220, then the second outlet valve 264 is moved to a similar position where exhaust gas from the second outlet 244 is directed through the low-pressure EGR outlet line 268 to a portion of the intake passage 42 upstream of the compressor 204.

Exhaust gas exiting the heat exchanger 210 and returning to the exhaust passage 48 may flow through one or more of the turbine 202 and the emission control device 70. As shown by the arrangement of the inlet and outlet passages, exhaust gas may not flow through the heat exchanger 210 and subsequently return to the heat exchanger without flowing through one or more of the turbine 202, compressor 204, and engine 10. Additionally or alternatively, if the first inlet valve 216 and the second inlet valve 226 are in the closed position, then exhaust gas remains in the exhaust passage 48 and does not flow to the heat exchanger 210.

In some examples, one or more of the valves disclosed herein are adjustable to a fully closed position, a fully open position, and any position therebetween. The fully closed position may prevent any gas flow therethrough. Oppositely, the fully open position may allow gas to flow freely therethrough. In one example, the fully closed position represents a valve position allowing a minimum amount of gas (e.g., zero) to flow therethrough and the fully open position represents a valve position allowing a maximum amount of gas (e.g., 100%) to flow therethrough. Positions between the fully open and fully closed may be described as more open or more closed positions, where a more open position allows more gas flow than a more closed position. In this way, gas flow may be metered between the fully open and fully closed positions.

Turning now to FIG. 3, it shows an embodiment 300 illustrating an isometric view of an inside of the heat exchanger 210. Specifically, the heat exchanger 210 is illustrated with a top surface being omitted such that its internal components may be visible.

An axis system 390 includes three axes, namely an x-axis parallel to a horizontal direction, a y-axis parallel to a vertical direction, and a z-axis perpendicular to both the x- and y-axes. A central axis 394 is shown via an alternating large-small dash line, where large dashes are longer than small dashes. A general direction of exhaust flow is shown by arrows 396 (herein referred to as exhaust flow 396). Exhaust flow 396 is substantially parallel to both the x-axis and the horizontal direction. The central axis 394 and the exhaust flow 396 are substantially parallel to a longitudinal axis of the heat exchanger 210. Gravity 392 is shown parallel to the y-axis and perpendicular to the direction of exhaust flow 396.

The heat exchanger 210 comprises a plurality of conduits 310. The conduits 310 may extend in a longitudinal direction parallel to the central axis 394. The conduits 310 may be longitudinally defined by partitions 312 and outer sidewalls 313A and 313B. One or more of the partitions 312 and the outer sidewalls 313A and 313B may comprise a thermal insulation. In one example, the thermal insulation may comprise of a thermally insulating material and/or a double walled construction. In this way, each conduit of the conduits 310 may be thermally insulated from adjacent conduits 310 and an ambient atmosphere.

The outer sidewalls 313A and 313B are arranged opposite one another and further comprise inner faces facing an interior of the heat exchanger 210 and outer faces facing an environment exterior to the heat exchanger. Specifically, the inner face of the outer sidewall 313A faces an interior of conduit 314 and the inner face of the outer sidewall 313B faces an interior of conduit 319. The partitions 312 may be arranged parallel to the outer sidewalls 313A and 313B. A spacing between each of the partitions 312 may be substantially equal. Furthermore, a spacing between the outer sidewall 313A and the nearest partition of the partitions 312 may be substantially equal to a spacing between the outer sidewall 313B and the nearest partition of the partitions 312. In this way, a volume of each conduit of the conduits 310 may substantially identical.

A number of partitions 312 may be less than a number of conduits 310. In one example, the number of partitions 312 is one less than the number of conduits 310. As shown, there are exactly five partitions 312 evenly arranged between the outer sidewalls 313A and 313B, forming six substantially identical conduits 310. In this way, the heat exchanger 210 is symmetrical, with a similar number of conduits 310 arranged on both sides of the central axis 394. It will be appreciated that other number of conduits 310, even or odd, have been contemplated herein, for example, 7, 8, 9, 10, and so on.

Specifically, in the example of FIG. 3, there are six conduits 310. A first conduit 314, a second conduit 315, a third conduit 316, a fourth conduit 317, a fifth conduit 318, and a sixth conduit 319 sequentially arranged between the first sidewall 313A and the second sidewall 313B. Thus, conduits 310 may refer to each of the first 314, second 315, third 316, fourth 317, fifth 318, and sixth 319 conduits unless otherwise specified. The first conduit 314 is arranged between the first sidewall 313A and the second conduit 315. The second conduit 315 is arranged between the first conduit 314 and the third conduit 316. The third conduit 316 is arranged between the second conduit 315 and the fourth conduit 317. The fourth conduit 317 is arranged between the third conduit 316 and the fifth conduit 318. The fifth conduit 318 is arranged between the fourth conduit 317 and the sixth conduit 319. The sixth conduit is arranged between the second sidewall 313B and the fourth conduit 317. A partition of the partitions 312 is arranged between each adjacent conduit. For example, a partition of the partitions 312 is arranged directly between the first conduit 314 and the second conduit 315. Adjacent is defined as a first object being directly next to a second object.

An inlet transition 330 may extend from the first inlet 211 and the second inlet 220 toward the conduits 310. The inlet transition 330 may include angled sidewalls 333A and 33B outwardly extending from the first 211 and second 220 inlets to the outer sidewalls 313A and 313B respectively. By doing this, a space for gas to flow through is increased relative to the volume of the first 211 and second 220 inlets. A portion of the partitions 312 arranged in the inlet transition 330 may be angled to or parallel with the central axis 394, where the angle is greater for partitions 312 further away from the central axis 394 than for partitions 312 nearer to the central axis 394. For example, the partition between the first conduit 314 and the second conduit 315 in the inlet transition 330 may be longer than or more angled than the partition between the second conduit 315 and the third conduit 316. In one example, a length of the partitions 312 in the inlet transition 330 increases as a distance between the partitions 312 and the central axis 394 increases. The inlet transition 330 may comprise a trapezoidal shape, however, other shapes have been contemplated.

A number of conduits 310 allocated to each of the first inlet 211 and the second inlet 220 may be adjusted by an inlet diverter valve 332 included in the inlet transition 330. In one example, the inlet diverter valve 332 is a flap. Portions of the inlet diverter valve 332 and partition nearest the outer sidewall 313A occluded by surfaces of the heat exchanger 210 are illustrated by medium dash lines. The inlet diverter valve 332 may be pivotally coupled to the barrier 232. Lateral displacement and/or pivoting of the inlet diverter valve 332 may adjust the number of conduits 312 allocated to the first 211 and second 220 inlets. In the example of FIG. 3, the inlet diverter valve 332 is shown coupled to the partition between the first conduit 314 and the second conduit 315. In the current position of the inlet diverter valve 332, the first inlet 211 is fluidly coupled to the first conduit 314 and the second inlet 220 is fluidly coupled to each of the second 315, third 316, fourth 317, fifth 318, and sixth 319 conduits.

A range of the inlet diverter valve 332 is shown by arc 334. In one example, the arc 334 comprises a half-circle shape, however, other shapes may be used (e.g., half-oval). The inlet diverter valve 332 is arranged to actuate 180°. The inlet diverter valve 332 may be pivoted and/or rotated to fixed locations such that the inlet diverter valve 332 is coupled to at least one of the angled sidewalls 333A, 333B or to a partition of the partitions 312. In one example, if the inlet diverter valve 332 is coupled to the angled sidewall 333B, then the second inlet 220 is fluidly sealed from the conduits 310. As such, the first inlet 211 is fluidly coupled to all the conduits 310. Alternatively, if the inlet diverter valve 332 is coupled to the angled sidewall 333A, then the first inlet 211 is fluidly sealed from the conduits 310 and the second inlet 220 is fluidly coupled to each of the conduits 310. The inlet diverter valve 332 may also be moved to positions corresponding to a partition of the partitions 312, wherein conduits between the inlet diverter valve 332 and the angled sidewall 333B are fluidly coupled to the second inlet 220 and conduits between the inlet diverter valve 332 and the angled sidewall 333A are fluidly coupled to the first inlet 211. If the inlet diverter valve 332 is coupled to a partition of the partitions arranged along the central axis 394, then a number of conduits fluidly coupled to the first 211 and second 220 inlets is equal, in one example. The barrier 232, inlet diverter valve 332, and partitions 312 maintain gases from the first 211 and second 220 inlets completely separate throughout a length of the heat exchanger 210. Furthermore, due to the thermally insulating properties of the partitions 312, the conduits 310 may not thermally communicate with one another.

Turning now to FIG. 4, it shows a cross-section 400 of the heat exchanger 210. The cross-section 400 may be taken along the longitudinal axis along a plane parallel to an x-z plane. The cross-section 400 depicts a coolant passage 480 traversing through the conduits 310 between outer surfaces 313A and 313B. In one example, the coolant passage 480 is a serpentine shape. The coolant passage 480 may be the only coolant passage arranged in the heat exchanger 210. As such, various gases flowing through any of the conduits 310 thermally communicate with only coolant in the coolant passage 480.

As shown in the cross-section 400, the outlet portion of the heat exchanger 210 is substantially identical to the inlet portion of the heat exchanger 210. Specifically, the outlet portion comprises an outlet diverter valve 434 moveable along an arc path 434 and pivotally coupled to the barrier 243. The outlet portion narrowing via an outlet transition 430 having angled sidewalls 433A and 433B.

In some examples, the heat exchanger 210 may include two coolant passages, where a first coolant passage is thermally coupled to only conduits between the central axis 294 and the second sidewall 313B and where a second coolant passage is thermally coupled to only conduits between the central axis 294 and the first sidewall 313A. By doing this, when the inlet diverter valve 332 is aligned with the central axis and each of the first inlet 211 and the second inlet 220 are coupled to an even number of conduits (e.g., three each), separate thermal environments are formed. Additionally or alternatively, each conduit of the conduits 310 may comprise its own coolant passage. In this way, the partitions 312 thermally isolate each conduit of the conduits 312 and coolant corresponding to a single conduit does not thermally communicate with coolant corresponding to a different conduit. Thus, a passage leading from the coolant system 280 to the heat exchanger 210 may divide into a number of coolant passages corresponding to a number of conduits 210 in the heat exchanger 210. The coolant passages may intersect and combine upon return to the coolant system 280 (e.g., from the heat exchanger 210 to the coolant system 280).

Small dash arrows 402 indicate a first gas flowing through the first inlet 211 and through the heat exchanger 210. In one example, the small dash arrows represent exhaust gas to be directed back to an exhaust passage (e.g., exhaust passage 48 of FIGS. 1 and 2). Large dash arrows 404 indicate a second gas flowing through the second inlet 220 and through the heat exchanger 210. In one example, the large dash arrows represent exhaust gas to be used as EGR. The EGR may be high-pressure or low-pressure without departing from the scope of the present disclosure.

The inlet diverter valve 332 is shown in a position biased toward the angled outer surface 333B (herein, upstream angled outer surface 333B). The outlet diverter valve 432 is shown in a similar position where the outlet diverter valve 432 is biased toward a downstream angled outer surface 433B. Specifically, the inlet diverter valve 332 and the outlet diverter valve 432 are both pivoted to a location corresponding to the partition of the partitions 312 arranged between the fourth conduit 317 and the fifth conduit 318. As such, the first 314, second 315, third 316, and fourth 317 conduits are fluidly coupled to the first inlet 211 and the fifth 318 and sixth 319 conduits are fluidly coupled to the second inlet 220.

As an example, the inlet diverter valve 332 and the outlet diverter valve 432 may be coupled to a common actuator such that actuation (e.g., pivoting) of the valves is mirrored. In this way, a number of conduits 310 fluidly coupled to the first inlet 211 is exactly equal to a number of conduits fluidly coupled to the first outlet 242. Likewise, a number of conduits 310 fluidly coupled to the second inlet 220 is exactly equal to a number of conduits 310 fluidly coupled to the second outlet 244. Additionally or alternatively, the inlet diverter valve 332 and the outlet diverter valve 432 may be coupled to separate actuators. However, instructions from a controller (e.g., controller 12 of FIG. 1) may be identical to each actuator such that actuation of the inlet diverter valve 332 is mimicked by the outlet diverter valve 432. In some examples, the inlet diverter valve 332 and the outlet diverter valve 432 are actuated independently of one another. In this way, a number of conduits 310 coupled to the first inlet 211 may be different than a number of conduits coupled to the first outlet 242. This may enable the heat exchanger 210 to provide a greater thermal range (e.g., increased cooling) to exhaust gases flowing therethrough.

The first gas 402 may flows from the first inlet 211, through each of the first 314, second 315, third 316, and fourth 317 conduits, and to the first outlet 242. The second gas 404 flows from the second inlet 220, through the fifth 318 and sixth 319 conduits, and to the second outlet 244. The first gas 402 and the second gas 404 do not mix. There are no other inlets or additional outlets in the heat exchanger 210 other than the first inlet 211, the first outlet 242, the second inlet 220, and the second outlet 244. In one example, the portion of the heat exchanger 210 corresponding to the first gas 402 is performing heat recovery and the portion of the heat exchanger 210 corresponding to the second gas 404 is performing EGR cooling.

In this way, the heat exchanger 210 may be divided to perform both heat exchanging and EGR cooling functions. The division may be dependent based on a variety of engine conditions, including but not limited to coolant temperature, engine temperature, engine load, and the like. By doing this, heat recovery and EGR cooling may be conducted in a single housing of the heat exchanger 210. A method for adjusting the inlet diverter valve 332 and the outlet diverter valve 432 based on one or more engine operating parameters is described below.

Turning now to FIG. 5, it shows a method 500 for adjusting the inlet and outlet diverter valves of a heat exchanger, such as the heat exchanger 210 of FIGS. 2-4. Instructions for carrying out method 500 may be executed by a controller (e.g., controller 12 of FIG. 1) based on instructions stored on a memory of the controller and in conjunction with signals received from sensors of the engine system, such as the sensors described above with reference to FIG. 1. The controller may employ engine actuators of the engine system to adjust engine operation, according to the methods described below.

The method 500 begins at 502, where the method includes determining, estimating, and/or measuring current engine operating parameters. The current engine operating parameters may include but are not limited to one or more of EGR flow rate, throttle position, manifold vacuum, engine temperature, coolant temperature, vehicle speed, and air/fuel ratio.

The method 500 may proceeds to 504, where the method may include determining if one or more first mode conditions are met. The first mode conditions may include determining if an engine temperature is greater than an upper threshold temperature at 506, determining if an engine $NO_x$ output is greater than a threshold output at 508, and determining if EGR cooling is desired at 509. The upper threshold temperature may be a non-zero value based on an engine operating temperature equal to an upper end of a desired engine temperature operating range. For example, if the desired engine temperature operating range is 180-210° C., then the upper threshold temperature may be between 205 to 210° C. The threshold output may be based on an amount of engine $NO_x$ output when the engine is operating within the desired engine temperature operating range. As such, the engine $NO_x$ output may be greater than the threshold output during an engine cold-start, where the engine temperature is less than the desired engine temperature operating range. In one example, first mode conditions are met if only EGR cooling is desired.

At 510, the method 500 may include determining if one or more second mode conditions are met. The second mode conditions may include determining if an engine temperature is less than a lower threshold temperature at 512, determining if a transmission temperature is less than a threshold transmission temperature at 514, and determining if cabin heating is demanded at 516. The lower threshold temperature may be a non-zero value based on an engine operating temperature equal to a lower end of the desired engine temperature operating range. For example, the lower threshold temperature may be equal to 180 to 185° C. Thus, the lower threshold temperature may be less than the upper threshold temperature in some examples. Similarly, the threshold transmission temperature may be substantially equal to a lower temperature in a desired transmission temperature operating range, which may be similar to the desired engine temperature operating range. As such, the threshold transmission temperature may be equal to 185 to 180° C. Cabin heating may be demanded by an occupant within the vehicle by depressing a button or turning a knob. Additionally or alternatively, a cabin heating demand may be predicted based on one or more of an ambient temperature and a cabin temperature.

At 518, the method 500 may determine if only the first mode conditions are met. In one example, this may include at least one of the conditions at 504 being met while none of the conditions at 510 are met. Additionally or alternatively, only the first mode conditions are met if an amount of EGR cooling desired is greater than a heat exchanger threshold. For example, if the amount of EGR cooling desired demands that all of the conduits of the heat exchanger (e.g., conduits 310 of heat exchanger 210 of FIGS. 3 and 4) be configured to cool EGR, then the only first mode conditions may be met and exhaust gas heat recovery may not be utilized within the heat exchanger. Additionally or alternatively, flowing EGR through the heat exchanger may heat coolant therein similar to heat recovery elements in the second mode such that cabin heating may still occur during the first mode. That is to say, cooling the EGR via the coolant may result in a temperature of the coolant increasing similar to a temperature increase experienced during heat recovery, such that cabin heating and the like may still be achieved during the first mode if desired.

If only the first mode conditions are met, then the method may proceed to 520 to enter the first mode and does not cool exhaust gas. Specifically, the heat exchanger does not cool exhaust gas destined to be returned directly to the exhaust passage. As such, the heat exchanger may only cool EGR during the first mode.

At 522, the method 500 may include adjusting the inlet diverter valve and the outlet diverter valve based on one or more of an EGR cooling desired and an amount of EGR desired. For example, if an increased amount of EGR cooling is desired and/or an increased amount of EGR is desired, then the inlet diverter valve and the outlet diverter valve may be actuated to couple more conduits to the second inlet and the second outlet (e.g., second inlet 220 and second outlet 244 of heat exchanger 210 of FIGS. 2, 3, and 4). Thus, if a decreased amount of EGR cooling is desired and/or a decreased amount of EGR is desired, then fewer conduits may be allocated to the second inlet and outlet.

Returning to 518, if the first mode conditions are not the only conditions met, then the method 500 may proceed to 524 to determine if only second mode conditions are met. In one example, at least one of the second mode conditions is met and none of the first mode conditions are met if the method 500 proceeds from 524 to 526. Additionally or alternatively, if at least one of the second mode conditions is met and EGR cooling is not demanded, then the method may proceed to 526 and enters the second mode.

At 526, the method 500 may include entering the second mode and does not cool EGR. As such, only heat recovery via exhaust gas may occur. It will be appreciated that EGR may still flow to the intake passage during the second mode. However, the EGR may not be cooled by the heat exchanger.

At 528, the method 500 may include adjusting the inlet diverter valve and the outlet diverter valve based on an amount of heat recovery desired. The amount of heat recovery desired may increase as a difference between the current engine temperature and the lower threshold temperature increases. For example, if the different between the current engine temperature and the lower threshold temperature is relatively high (e.g., a cold-start where the current engine temperature is less than an ambient temperature), then the amount of heat recovery desired may be relatively high and the inlet diverter valve and the outlet diverter valve may be moved to a position to allocate a majority or all of the conduits of the heat exchanger to the first inlet and the first outlet (e.g., first inlet 211 and first outlet 242 of heat exchanger 210 of FIGS. 2, 3, and 4). This may decrease a duration of the cold-start. Additionally or alternatively, if a vehicle occupant demands an increased amount of cabin heating, then more conduits may be allocated and/or fluidly coupled to the first inlet and first outlet, resulting in greater heat recovery. Thus, if the vehicle occupant desires less cabin heating, then fewer conduits may be allocated to the first inlet and first outlet, resulting in decreased heat recovery.

It will be appreciated that EGR may not be desired during cold-start conditions. As such, EGR may not flow to the heat exchanger during the cold-start. However, exhaust gas may flow to the heat exchanger, thereby allowing the heat exchanger to utilize the hot exhaust gas to heat engine oil and/or coolant, decreasing the cold-start duration without concern for condensate formation.

Returning to 524, if at least one of the first mode conditions and the second mode conditions is met, then the method 500 may proceed to 530. For example, if EGR cooling is desired and one or more of cabin heating and transmission heating is desired, then the method proceeds to 530.

At 532, the method 500 may include entering the third mode and cooling EGR and performing exhaust gas heat recovery. In one example, the heat exchanger performs EGR cooling and heat recovery in a single, common housing.

At 534, the method 500 may include adjusting the inlet diverter valve and the outlet diverter valve based on a combination of one or more of the desired EGR cooling and the desired exhaust gas heat recovery. In one example, priority is given to the desired EGR cooling. For example, if the amount of desired EGR cooling is high and a majority of the conduits of the heat exchanger are needed to meet the desired EGR cooling, then the controller may signal to actuators of the inlet diverter valve and the outlet diverter valve to allocate a majority of the conduits to the second inlet and the second outlet of the heat exchanger. This may occur even if the desired exhaust gas heat recovery is relatively high and a majority of the conduits are needed to provide the desired energy recovery. This may be due to the EGR cooling providing similar heating of the coolant as exhaust gas that would be redirected back to the exhaust passage. By doing this, EGR cooling demands may be met and cabin heating demands and/or transmission heating demands may also be met. In this way, EGR is cooled and energy heat recovery is carried out simultaneously within a shared heat exchanger.

Returning to 530, if the method 500 determines that none of the first conditions and second conditions are met, then the method 500 may proceed to 536. At 536, the method 500 may include not flowing EGR or exhaust gas to the heat exchanger and maintaining current engine operating parameters.

Turning now to FIG. 6, it shows an embodiment 600 of a heat exchanger 610 having a housing 612 comprising three chambers. The chambers corresponding to a charge air cooler (CAC) chamber 620, exhaust gas heat recovery chamber 630, and EGR cooler chamber 640. The exhaust gas heat recovery chamber 630 is arranged between the EGR cooling chamber 640 and the CAC chamber 620 in the housing 612. However, other arrangements of the chambers may be used without departing from the scope of the present disclosure.

In one example, the heat exchanger 610 may be used with engine 10 of FIGS. 1 and 2. Thus, components previously introduced may be similarly numbered in the example of FIG. 6. As such, the heat exchanger 610 may be used in place of the heat exchanger 210 of FIGS. 2-4 in a vehicle system (e.g., vehicle 5 of FIG. 1). Additionally or alternatively, both heat exchanger 210 and heat exchanger 610 may be included with the vehicle 5. The controller 12 of FIG. 1 may be electronically coupled to one or more of the valves described herein with reference to the embodiment 600.

The heat exchanger 610 may be fluidly coupled to a coolant system 680. An upstream passage 681 may lead to a first coolant valve 682. A first downstream passage 683 and a second downstream passage 685 may fluidly couple the upstream passage 681 to a second coolant valve 684 and a third coolant valve 686. In one example, the first coolant valve 682 is a three-way valve configured to adjust an amount of coolant flowing from the upstream passage 681 to each of the first downstream passage 683 and the second downstream passage 685. Thus, in some positions of the first coolant valve 682, some coolant from the upstream passage 681 may flow into each of the first 683 and second 685 downstream passages, only the first downstream passage 683, and only the second downstream passage 685. Additionally or alternatively, the first coolant valve 682 may further comprise a fully closed position where no coolant flows to both the first 683 and the second 685 downstream passages.

Coolant in the first downstream passage 683 may flow into one or more of CAC coolant passages 622 or exhaust gas heat recovery coolant passages 632 based on a position of the second coolant valve 684. In one example, the second coolant valve 684 is a three-way valve substantially identical to the first coolant valve 682. As such, the second coolant valve 684 may flow coolant simultaneously to both the CAC coolant passages 622 and the exhaust gas heat recovery coolant passages 632. Additionally, the second coolant valve 684 may be configured to flow coolant from the first downstream passage 683 to CAC coolant passages 622 and not directly to the exhaust gas heat recovery coolant passages 632, or vice versa. As such, portions of the second coolant valve 684 may be moved independently (e.g., separate portions corresponding to the CAC coolant passages 622 or the exhaust gas heat recovery coolant passages 632) to adjust coolant flow to each of the CAC chamber 620 and the exhaust gas heat recovery chamber 630.

Similarly, coolant in the second downstream passage 685 may flow into one or more of the exhaust gas heat recovery coolant passages 632 or EGR coolant passages 642 based on a position of the third coolant valve 686. In one example, the third coolant valve 686 is substantially identical to the first 682 and second 684 coolant valves. As such, the third coolant valve 686 is a three-way valve. Therefore, the third coolant valve 686 may flow coolant simultaneously to both the exhaust gas heat recovery coolant passages 632 and the EGR coolant passages 642. Additionally, the third coolant valve 686 may be configured to flow coolant from the second downstream passage 685 to the EGR coolant passages 642 and not directly to the exhaust gas heat recovery coolant passages 632 or vice versa. Thus, portions of the third coolant valve 686, separately corresponding to the exhaust gas heat recovery coolant passages 632 and the EGR coolant passages 642, may be independently actuated to adjust coolant flow to each of the exhaust gas heat recovery chamber 630 and the EGR chamber 640.

Coolant may be returned to the coolant system 680 via an outlet coolant passage 687. Coolant from each of the CAC coolant passages 622, exhaust gas heat recovery coolant passages 632, and EGR cooler coolant passages 642 may merge in the outlet coolant passage 687 before returning to the coolant system 680. In some examples, additionally or alternatively, each of the CAC coolant passages 622, exhaust gas heat recovery coolant passages 632, and EGR cooler coolant passages 642 may comprise a separate outlet such that coolant from each of the CAC coolant passages 622, exhaust gas heat recovery coolant passages 632, and EGR cooler coolant passages 642 does not mix before returning to the coolant system 680.

As shown, each of the CAC chamber 620, the exhaust gas heat recovery chamber 630, and the EGR cooler chamber 640 may be isolated via first 614 and second 616 barriers. Specifically, the first barrier 614 may separate the CAC chamber 620 and the exhaust gas heat recovery chamber 630 and the second barrier 616 may separate the exhaust gas heat recovery chamber 630 and the EGR cooler chamber 640. The first 614 and second 616 barriers may function to prevent gases mixing between each of the chambers. As such, charge air in the CAC chamber 620 does not mix with exhaust gas in the exhaust gas heat recovery chamber 630 and EGR in the EGR cooler chamber 640. Likewise, exhaust gas in the exhaust gas heat recovery chamber 630 does not mix with EGR in the EGR cooler chamber 640. Additionally or alternatively, the first barrier 614 and/or the second barrier 616 may comprise a thermally insulating material and/or a double walled construction to prevent and/or mitigate thermal communication between each of the CAC chamber 620, the exhaust gas heat recovery chamber 630, and the EGR cooler chamber 640.

The turbine 202 and the compressor 204 are arranged in the exhaust passage 48 and the intake passage 42, respectively. As shown, the intake passage 42 may lead directly to the CAC chamber 620 of the heat exchanger 610. Thus, the compressor 204 is fluidly coupled to the CAC chamber 620, and air compressed by the compressor 204 may be cooled by CAC coolant passages 622 in the CAC chamber 620.

The embodiment 600 further includes a compressor bypass 602 having a compressor bypass valve 604. When the bypass valve 604 is in an at least partially open position (e.g., not a fully closed position), then at least a portion of intake air in the intake passage 42 upstream of the compressor 204 may flow into the compressor bypass 602 and flow around the compressor 204 and the CAC chamber 620 of the heat exchanger 610. In this way, intake air bypassing the compressor 204 and the CAC chamber 620 is not compressed or cooled and may flow directly through a remainder of the intake passage 42 to the engine 10.

Exhaust gases produced in the engine 10 and directed to the exhaust passage 48 may flow directly through the turbine 202 and a remainder of the exhaust passage 48 when a first exhaust valve 644 and a second exhaust valve 646 are in fully closed positions. Said another way, when the first exhaust valve 644 and the second exhaust valve 646 are in fully closed positions, exhaust gas from the exhaust passage 48 may not flow to the heat exchanger 610.

Intake and/or exhaust gases may flow into the heat exchanger 610 when one or more of the bypass valve 604 is in an at least partially closed position (e.g., not in a fully open position), the first exhaust valve 644 is in an at least partially open position, and/or the second exhaust valve 646 is in an at least partially open position. The intake and/or exhaust gases may thermally communicate with one or more coolant passages traversing each of the CAC chamber 620, the exhaust gas heat recovery chamber 630, and the EGR cooler chamber 640. In one example, the first exhaust valve 644 is a three-way valve similar to the first coolant valve 682, second coolant valve 684, and third coolant valve 686.

When the bypass valve 604 is in an at least partially closed position, intake air may flow through the compressor 204 and into the CAC chamber 620. The charge air from the compressor 204 in the CAC chamber 620 may be cooled via the CAC coolant passages 622 when coolant is directed from the first downstream passage 683 to the CAC coolant passages 622 when the portion of the second coolant valve 684 corresponding to the CAC coolant passages 622 is at least partially open.

The CAC cooler chamber 620 may be further coupled to a port exhaust thermactor air (PETA) passage 650 via a PETA valve 652. The PETA passage 650 may direct charge air from the CAC cooler chamber 620 to the exhaust passage 48 at a location upstream of the turbine 202. As such, the charge air flowing through the PETA passage 650 to the exhaust passage 48 may increase a concentration of air in the exhaust gas in the exhaust passage 48 and may help drive the turbine 202. By doing this, exhaust gas may be artificially made leaner, even when the engine 10 is running rich, to adjust one or more exhaust conditions to leaner conditions more suitable for some aftertreatment devices. For example, the PETA valve 652 may be moved to an at least partially open position to allow charge air through the PETA passage 650 to the exhaust passage 48 when a particulate filter regeneration is desired. When the PETA valve 652 is closed, no charge air flows to the PETA passage 650 and all the charge air in the CAC chamber 620 flows to the engine 10, in one example.

In one example, the PETA passage 650 extends from outside of the CAC chamber 620, through a portion of the EGR cooler chamber 640, and to the exhaust passage 48. The portion of the EGR cooler chamber 640 through which the PETA passage 650 extends may be a portion distal to the EGR cooler coolant passage 642 such that EGR in the portion has not yet been cooled. This may allow EGR in the EGR cooler chamber 640 to warm the charge air in the PETA passage 650 to one or more of increase its pressure to drive the turbine 202 faster, increase its temperature to light-off one or more catalysts, and to increase its temperature to regenerate a particulate filter. Additionally or alternatively, the PETA passage 650 may not extend through the EGR cooler chamber 640 and may extend directly to the exhaust passage 48 without any components located therebetween.

When a portion of the first exhaust valve 644 corresponding to the exhaust gas heat recovery chamber 630 is in an at least partially open position, a portion of exhaust gas from the exhaust passage 48 is directed to and flows through the exhaust gas heat recovery chamber 630. Exhaust gas in the exhaust gas heat recovery chamber 630 may thermally communicate with coolant in the exhaust gas heat recovery chamber coolant passages 632 when coolant is directed to flow thereto via one or more of second coolant valve 684 and third coolant valve 686, as described above. Exhaust gas in the exhaust gas heat recovery chamber 630 may return to a portion of the exhaust passage 48 downstream of the turbine 202 via an exhaust gas heat recovery chamber outlet 634.

When a portion of the first exhaust valve 644 corresponding to the EGR cooler chamber 640 is in an at least partially open position, such that high-pressure EGR is allowed through the first exhaust valve 644, or when the second exhaust valve 646 is in an at least partially open position, such that low-pressure EGR is allowed through the second exhaust valve 646, then a portion of exhaust gas from the exhaust passage 48 may flow to the EGR cooler chamber 640. It will be appreciated that high-pressure EGR and low-pressure EGR may not flow simultaneously to the EGR cooler chamber 640. As such, if the portion of the first exhaust valve 644 corresponding to the EGR cooler chamber 640 is in an at least partially open position, then the second exhaust valve 646 may be adjusted to a fully closed position, or vice-versa. At any rate, before EGR is cooled in the EGR cooler chamber 640, it may heat one or more of charge air in the PETA passage 650, as described above, and high-pressure fuel in a high-pressure fuel passage 662. A high-pressure fuel system 660 may direct high-pressure fuel to the high-pressure fuel passage 662 before directing the high-pressure fuel to the engine 10 to improve combustion characteristics. For example, by heating the high-pressure fuel, the fuel may mix with air in the combustion chamber more readily, thereby increasing combustion stability and reducing a likelihood of unburned fuel impinging onto surfaces of the combustion chamber. The EGR may contact the EGR cooler coolant passages 642 and thermally communicate with coolant therein. The EGR may be selectively cooled by adjusting a position of the third coolant valve 686 to adjust an amount of coolant flowing to the EGR cooler coolant passages 642. As such, the EGR may be optionally uncooled by not flowing any coolant to the EGR cooler coolant passages 642. Low-pressure EGR may flow to a portion of the intake passage 42 upstream of the compressor 204 via a low-pressure EGR passage 644. High-pressure EGR may flow from the EGR cooler chamber to a portion of the intake passage 42 upstream of the compressor 204 via a high-pressure EGR passage 646.

It will be appreciated that gas flow to the heat exchanger may be adjusted based on a plurality of engine operating conditions. During come conditions, charge air, exhaust gas, and EGR may respectively flow to the CAC chamber 620, the exhaust gas heat recovery chamber 630, and the EGR cooler chamber 640 simultaneously. Additionally or alternatively, charge air may not flow to the CAC chamber 620, while exhaust gas flows to the exhaust gas heat recovery chamber 630 and EGR flows to the EGR cooler chamber 640. Additionally or alternatively, exhaust gas may not flow to the exhaust gas heat recovery chamber, while charge air flows to the CAC chamber 620 and EGR flows to the EGR cooler chamber 640. Additionally or alternatively, EGR may not flow to the EGR cooler chamber 640, while charge air flows to the CAC chamber 620 and exhaust gas flows to the exhaust gas heat recovery chamber 630.

In this way, a heat exchanger comprising a single housing may be configured to receive different gas flows. The heat exchanger may comprise one or more valves configured to adjust an allocation of conduits and/or coolant passages in the heat exchanger to fluidly communicate with one or more of the gases flowing therein. The technical effect of flowing multiple gases to the heat exchanger within a single housing is decrease packaging constraints and manufacturing costs. The heat exchanger may further comprise a plurality of conduits with coolant passages extending therethrough, with inlet and outlet diverter valves shaped similar to a flap, the valves configured to allocate a number of conduits to receive a first gas to be directed to an intake passage and a remaining number of conduits to receive a second gas to be directed to an exhaust passage.

A method for an engine comprises adjusting a number of heat exchanger conduits allocated to receive exhaust gas recirculate and correspondingly adjusting a number of heat exchanger conduits allocated to receive exhaust gas by pivoting a flap, and where the heat exchanger conduits are fluidly sealed from one another. A first example of the method further includes where the adjusting includes increasing the number of heat exchanger conduits allocated to receive exhaust gas recirculate and decreasing the number of heat exchanger conduits allocated to receive exhaust gas in response to an increased exhaust gas recirculate cooling demand. A second example of the method optionally including the first example further includes where the exhaust gas recirculate cooling demand increases in response to one or more of engine $NO_x$ output being greater than a threshold $NO_x$ output, and an engine temperature being greater than a threshold engine temperature. A third example of the method, optionally including the first and/or second examples, further includes where the adjusting includes decreasing the number of heat exchanger conduits allocated to receive exhaust gas recirculate and increasing the number of heat exchanger conduits allocated to receive exhaust gas in response to an increased energy recovery demand. A fourth example of the method, optionally including one or more of the first through third examples, further includes where the increased energy recovery demand is in response to one or more of an engine cold-start, vehicle cabin heating demand, and transmission temperature. A fifth example of the method, optionally including one or more of the first through fourth examples, further includes where the flap is pivoted clockwise to increase a number of heat exchanger conduits allocated to receive exhaust gas recirculate and where the flap is pivoted counterclockwise to increase a number of heat exchanger conduits allocated to receive exhaust gas, and where the flap is an inlet flap, the heat exchanger further comprising an outlet flap, and where the outlet flap mimics the movement of the inlet flap. A sixth example of the method, optionally including one or more of the first through fifth examples, further includes where the exhaust gas recirculate is one or more of high-pressure exhaust gas recirculate and low-pressure exhaust gas recirculate, and where the exhaust gas recirculate flows to an intake passage coupled to an engine after flowing through the heat exchanger. A seventh example of the method, optionally including one or more of the first through sixth examples, further includes where the exhaust gas is one or more of high-pressure and low-pressure exhaust gas, and where the exhaust gas flows to an exhaust passage coupled to an engine after flowing through the heat exchanger. An eighth example of the method, optionally including one or more of the first through seventh examples, further includes where flowing only exhaust gas recirculate to the heat exchanger and allocating one to all of the heat exchanger conduits to receive exhaust gas recirculate during a first mode, and where a second mode comprises flowing only exhaust gas to the heat exchanger and allocating one to all of the heat exchanger conduits to receive exhaust gas, and where a third condition comprises flowing both exhaust gas recirculate and exhaust gas to the heat exchanger and where a first number of heat exchanger conduits are allocated to receive exhaust gas recirculate and where a second number of heat exchanger conduits are allocated to receive exhaust gas.

A system comprises a heat exchanger partitioned into a plurality of fluidly separated conduits, a first inlet and a first outlet configured to flow a first fluid in and out of the heat exchanger, a second inlet and a second outlet configured to flow a second fluid in and out of the heat exchanger, an inlet flap configured to adjust a number of conduits fluidly coupled to the first and second inlets and an outlet flap configured to adjust a number of conduits fluidly coupled to the first and second outlets, where the number of conduits fluidly coupled to the first and second inlets is equal to the number of conduits fluidly coupled to the first and second outlets, respectively, and a controller with computer-readable instructions that when executed enable the controller to pivot the inlet and outlet flaps in a first direction to increase a number of conduits fluidly coupled to the first inlet and first outlet and decrease a number of conduits fluidly coupled to the second inlet and second outlet when the first fluid demands greater cooling than the second fluid and pivot the inlet and outlet flaps in a second direction to increase the number of conduits fluidly coupled to the second inlet and second outlet and decrease the number of conduits fluidly coupled to the first inlet and second inlet when the second fluid demands greater cooling than the first fluid.

A first example of the system further includes where the first and second inlets are fluidly coupled to portions of an exhaust passage upstream and downstream of a turbine, and where the first outlet is fluidly coupled to the portions of the exhaust passage upstream and downstream of the turbine and where the second outlet is fluidly coupled to portions of an intake passage upstream and downstream of a compressor. A second example of the system, optionally including the first example, further includes where the heat exchanger is partitioned into an even number of fluidly separated conduits. A third example of the system, optionally including one or more of the first and second examples, further includes where the number of fluidly separated conduits is six or more. A fourth example of the system, optionally including one or more of the first through third examples, further includes where the first fluid and second fluid do not mix and are maintained separate through the heat exchanger. A fifth example of the system, optionally including one or more of the first through fourth examples, further includes where the heat exchanger comprises a single coolant passage traversing each of the fluidly separated conduits a plurality of times.

An engine system comprises a heat transfer device comprising inlet and outlet flaps pivotally arranged to adjust a volume of the heat transfer device for exhaust gas recirculate to flow through, where the volume is increased by increasing a number of conduits fluidly coupled to an exhaust gas recirculate inlet and outlet, and where the increasing further includes decreasing a number of conduits fluidly coupled to an exhaust gas inlet and outlet, where each conduit of the conduits is hermetically sealed from other conduits. A first example of the engine system optionally includes where adjusting the volume of the heat transfer device for exhaust gas recirculate to flow through, where the volume is decreased by decreasing the number of conduits fluidly coupled to the exhaust gas recirculate inlet and outlet, and where the decreasing further includes increasing a number of conduits fluidly coupled to the exhaust gas inlet and outlet, and where the exhaust gas recirculate outlet is coupled to an intake passage and the exhaust gas outlet is coupled to an exhaust passage. A second example of the engine system, optionally including the first example, further includes where a controller with computer-readable instructions stored thereon that when executed enable the controller to increase the number of conduits for exhaust gas recirculate to flow through in response to exhaust gas recirculate flow increasing, engine $NO_x$ output increasing, and engine temperature increasing, and decrease the number of conduits for exhaust gas recirculate to flow through in response to exhaust gas recirculate flow decreasing, an engine cold-start, and energy recovery demand increasing. A third example of the engine system, optionally including one or more of the first through third examples, further includes where the exhaust gas recirculate inlet is adjacent to and fluidly separated from the exhaust gas inlet by an inlet barrier, and where the inlet flap is physically coupled to an extreme end of the inlet barrier, and where the exhaust gas recirculate outlet is adjacent to and fluidly separated from the exhaust gas outlet by an outlet barrier, and where the outlet flap is physically coupled to an extreme end of the outlet barrier. A fourth example of the engine system, optionally including one or more of the first through third examples, further includes where there are no other inlets or additional outlets in the heat exchanger other than the exhaust gas recirculate inlet and outlet and the exhaust gas inlet and outlet.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

adjusting a number of heat exchanger conduits allocated to receive exhaust gas recirculate and correspondingly adjusting the number of heat exchanger conduits allocated to receive exhaust gas by pivoting a flap between three or more positions and each position allocating a different number of heat exchanger conduits, where the heat exchanger conduits are separated from one another by partitions, and the heat exchanger conduits allocated to receive exhaust gas flow the exhaust gas into an exhaust passage downstream of an engine.

2. The method of claim 1, wherein the adjusting includes increasing the number of heat exchanger conduits allocated to receive exhaust gas recirculate from one conduit to two or more conduits and decreasing the number of heat exchanger conduits allocated to receive exhaust gas in response to an increased exhaust gas recirculate cooling demand from two or more conduits to one conduit.

3. The method of claim 2, wherein the number of heat exchanger conduits allocated to receive exhaust gas recirculate increases in response to an engine $NO_x$ output being greater than a threshold $NO_x$ output, and the adjusting allocating the number of heat exchanger conduits between zero conduits, 1 conduit, 2 conduits, and 3 or more conduits.

4. The method of claim 1, wherein the adjusting includes decreasing the number of heat exchanger conduits allocated to receive exhaust gas recirculate from two or more conduits to one conduit and correspondingly increasing the number of heat exchanger conduits allocated to receive exhaust gas in response to an increased energy recovery demand.

5. The method of claim 4, wherein the increased energy recovery demand is in response to one or more of an engine cold start, a vehicle cabin heating demand, and a transmission temperature.

6. The method of claim 1, wherein the flap is pivoted between the positions and each position is aligned with one of the partitions separating different exhaust gas conduits, the flap pivoted in a first direction to increase the number of heat exchanger conduits allocated to exhaust gas recirculate and where the flap is pivoted in a second direction, opposite to the first direction, to increase the number of heat exchanger conduits allocated to exhaust gas, and where the flap is an inlet flap, a heat exchanger further comprising an outlet flap, and where the outlet flap mimics the movement of the inlet flap.

7. The method of claim 1, wherein the exhaust gas recirculate flows through an outlet valve which directs the exhaust gas through a high-pressure exhaust gas recirculate outlet or a low-pressure exhaust gas recirculate outlet in an intake passage of the engine after the exhaust gas flows through a heat exchanger.

8. The method of claim 1, wherein the exhaust gas is one or more of high-pressure and low-pressure exhaust gas, and where the exhaust gas flows to an outlet in an exhaust passage downstream of the engine after flowing through a heat exchanger.

9. The method of claim 1, further comprising flowing only exhaust gas recirculate to a heat exchanger and allocating one of all of the heat exchanger conduits to receive exhaust gas recirculate during a first mode, and where a second mode comprises flowing only exhaust gas to the heat exchanger and allocating one of all of the heat exchanger conduits to receive exhaust gas, and where a third mode comprises flowing both exhaust gas recirculate and exhaust gas to the heat exchanger and where a first number of heat exchanger conduits are allocated to receive exhaust gas recirculate and where a second number of heat exchanger conduits are allocated to receive exhaust gas.

10. The method of claim 1, further including pivoting the flap to increase the number of heat exchanger conduits allocated to receive exhaust gas recirculate from one conduit to two or more conduits and correspondingly decrease the number of heat exchanger conduits allocated to receive exhaust gas when an engine temperature is greater than a temperature threshold or a NOx output is greater than an NOx threshold.

11. The method of claim 10, further including pivoting the flap to decrease the number of heat exchanger conduits allocated to receive exhaust gas recirculate from two or more conduits to one conduit and correspondingly increase the number of heat exchanger conduits allocated to receive exhaust gas when an engine temperature is less than a second temperature threshold and a transmission temperature is less than a transmission temperature threshold.

12. The method of claim 1, further including pivoting the flap to adjust the number of heat exchanger conduits allocated to receive exhaust gas recirculate and exhaust gas based on a determined amount of desired exhaust gas recirculate cooling and exhaust gas heat recovery.

13. The method of claim 12, wherein the determined amount of desired exhaust gas recirculate cooling is based on an engine temperature and a NOx output.

14. The method of claim 12, wherein the determined amount of desired exhaust gas heat recovery is based on engine temperature, transmission temperature, and cabin heating demand.

* * * * *